US009124051B2

(12) United States Patent
Tanaka et al.

(10) Patent No.: US 9,124,051 B2
(45) Date of Patent: Sep. 1, 2015

(54) CONNECTOR INCLUDING PAIRS OF CONTACTS FOR HIGH-SPEED SIGNAL TRANSMISSION HAVING SIGNAL CONTACT PORTIONS SURROUNDED BY GROUND CONTACT PORTIONS

(71) Applicant: Japan Aviation Electronics Industry, Limited, Tokyo (JP)

(72) Inventors: Yukitaka Tanaka, Tokyo (JP); Chikara Kawamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 13 days.

(21) Appl. No.: 14/159,660

(22) Filed: Jan. 21, 2014

(65) Prior Publication Data

US 2014/0235109 A1 Aug. 21, 2014

(30) Foreign Application Priority Data

Feb. 20, 2013 (JP) ..... 2013-031307

(51) Int. Cl.
*H01R 24/00* (2011.01)
*H01R 24/76* (2011.01)
(Continued)

(52) U.S. Cl.
CPC ..... *H01R 24/76* (2013.01); *H01R 13/6471* (2013.01); *H01R 23/005* (2013.01); *H01R 24/60* (2013.01)

(58) Field of Classification Search
CPC ..... H01R 23/005
USPC ..... 439/660
See application file for complete search history.

(56) References Cited

U.S. PATENT DOCUMENTS 6,976,886 B2 12/2005 Winings et al.
6,988,902 B2 1/2006 Winings et al.
(Continued)

FOREIGN PATENT DOCUMENTS

JP 2005-518067 A 6/2005
JP 2010-287560 A 12/2010
(Continued)

OTHER PUBLICATIONS

Japanese Office Action dated Feb. 27, 2014 in Japanese Application No. 2013-031307.

*Primary Examiner* — Abdullah Riyami
*Assistant Examiner* — Justin Kratt
(74) *Attorney, Agent, or Firm* — Collard & Roe, P.C.

(57) ABSTRACT

A connector has signal contacts and ground contacts, each of which includes a contact portion to be connected with a mating connector. In a predetermined plane, the contact portions of the signal contacts and the contact portions of the ground contacts are grouped and arranged into a first line and a second line. In the predetermined plane, four specific signal contact portions are surrounded by four specific ground contact portions. The four specific signal contact portions are the contact portions of the signal contacts constituting two pairs. The four specific ground contact portions are two of the contact portions of the ground contacts belonging to the first line and two of the contact portions of the ground contacts belonging to the second line. In the predetermined plane, a minimum distance between two of the specific ground contact portions is smaller than another minimum distance between one of the specific signal contact portions and one of the contact portions of the signal contacts other than the specific signal contact portions.

4 Claims, 5 Drawing Sheets

(51) Int. Cl.
*H01R 13/6471* (2011.01)
*H01R 24/60* (2011.01)

(56) References Cited

U.S. PATENT DOCUMENTS

| | | | | |
|---|---|---|---|---|
| 7,114,964 | B2 | 10/2006 | Winings et al. | |
| 7,674,118 | B2 | 3/2010 | He | |
| 7,845,961 | B2 | 12/2010 | Zhu et al. | |
| 8,506,332 | B2 | 8/2013 | Sommers et al. | |
| 2004/0097112 | A1* | 5/2004 | Minich et al. | 439/101 |
| 2008/0214029 | A1 | 9/2008 | Lemke et al. | |
| 2008/0248693 | A1 | 10/2008 | Winings et al. | |
| 2011/0097933 | A1* | 4/2011 | Sommers et al. | 439/607.34 |
| 2012/0270445 | A1 | 10/2012 | Kondo | |
| 2013/0337663 | A1 | 12/2013 | Shiratori et al. | |

FOREIGN PATENT DOCUMENTS

| | | | |
|---|---|---|---|
| JP | 2011-519463 | A | 7/2011 |
| JP | 4865089 | B2 | 2/2012 |
| JP | 2012-226903 | A | 11/2012 |
| JP | 2012-227025 | A | 11/2012 |

* cited by examiner

CONNECTOR INCLUDING PAIRS OF CONTACTS FOR HIGH-SPEED SIGNAL TRANSMISSION HAVING SIGNAL CONTACT PORTIONS SURROUNDED BY GROUND CONTACT PORTIONS

CROSS REFERENCE TO RELATED APPLICATIONS

An applicant claims priority under 35 U.S.C. §119 of Japanese Patent Application No. JP2013-031307 filed Feb. 20, 2013.

BACKGROUND OF THE INVENTION

The present invention relates to a connector which includes a plurality of pairs of contacts for high-speed signal transmission.

An existing connector of this type is disclosed in JP2011-519463T. As shown in FIG. 10, the existing connector comprises a plurality of pairs of high-speed signal contacts and a plurality of ground contacts. Those contacts are arranged in two lines on a mating portion of the existing connector. In each line, each pair of the high-speed signal contacts is positioned between two ground contacts. In addition, one pair of high-speed signal contacts belonging to one line and one ground contact belonging to the other line are arranged in a triangle form.

SUMMARY OF THE INVENTION

It is an object of the present invention to provide a connector which has a superior high-speed signal transmission property in comparison with the existing connector.

One aspect of the present invention provides a connector which is to be mated with a mating connector along a mating direction. The connector comprises a plurality of pairs of signal contacts, a plurality of ground contacts and a holder which holds the pairs of the signal contacts and the ground contacts. Each of the signal contacts and the ground contacts includes a contact portion to be connected with the mating connector. In a predetermined plane perpendicular to the mating direction, the contact portions of the signal contacts and the contact portions of the ground contacts are grouped and arranged into a first line and a second line. In the predetermined plane, four specific signal contact portions are surrounded by four specific ground contact portions, wherein: the four specific signal contact portions are the contact portions of the signal contacts constituting two of the pairs; and the four specific ground contact portions are two of the contact portions of the ground contacts belonging to the first line and two of the contact portions of the ground contacts belonging to the second line. In the predetermined plane, a minimum distance between two of the specific ground contact portions is smaller than another minimum distance between one of the specific signal contact portions and one of the contact portions of the signal contacts other than the specific signal contact portions.

Since the four specific signal contact portions are surrounded by the four specific ground contact portions while the minimum distance between two specific ground contact portions is smaller than the minimum distance between the specific signal contact portion and the contact portion of the signal contact other than the specific signal contact portion, bad influences that the contact portions of the signal contacts other than the specific signal contact portions have on the specific signal contact portions can be reduced.

An appreciation of the objectives of the present invention and a more complete understanding of its structure may be had by studying the following description of the preferred embodiment and by referring to the accompanying drawings.

BRIEF DESCRIPTION OF THE DRAWINGS

FIG. 7 is an enlarged, cross-sectional view showing a part of the connector of

FIG. 6.

Figure 1:
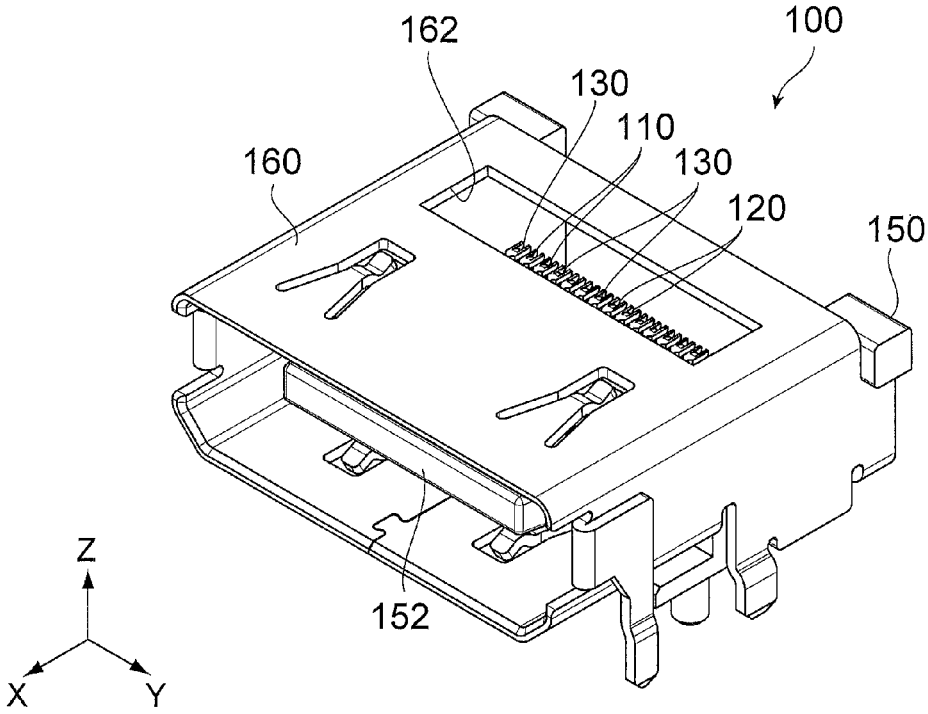
FIG. 1 is a front oblique view showing a connector according to a preferred embodiment of the present invention.
Figure 2:
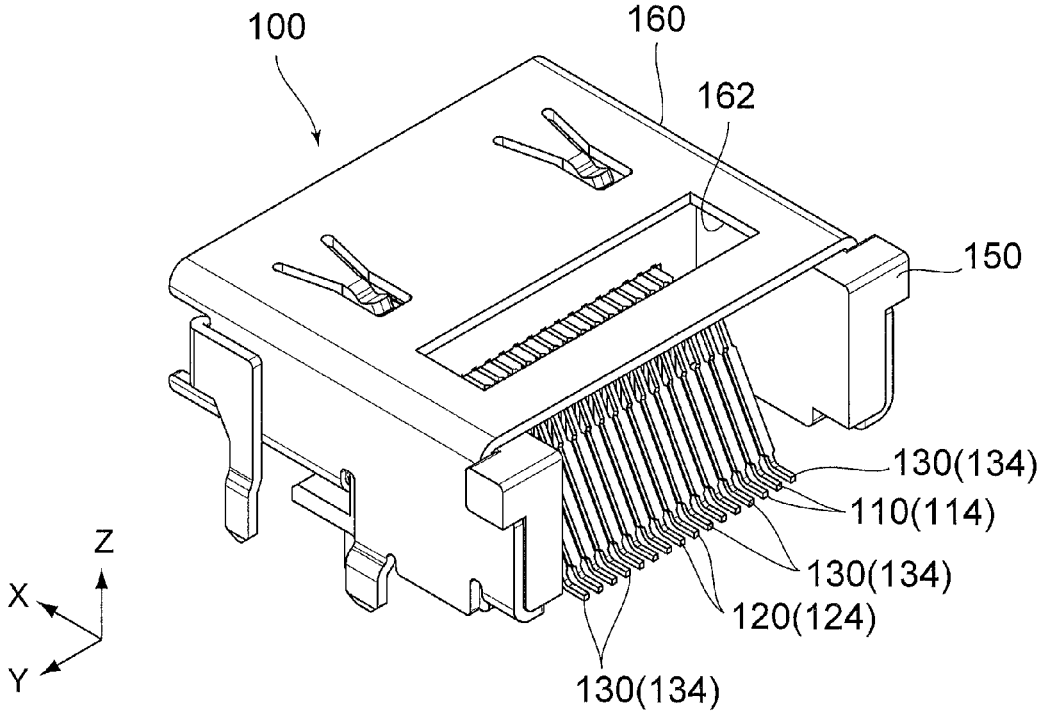
FIG. 2 is a back oblique view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

With reference to FIGS. 1 to 6, a connector 100 according to an embodiment of the present invention is a receptacle connector and is mateable with a mating connector or plug connector (not shown) along a mating direction (X-direction: front-rear direction). The connector 100 is mounted and fixed to a circuit board (object: not shown) when used.

The illustrated connector 100 comprises a plurality of pairs of signal contacts 110, a plurality of pairs of signal contacts 120, a plurality of ground contacts 130, a holder 150 made of insulator and a shell 160 made of metal.

The holder 150 holds the aforementioned contacts, i.e., the signal contacts 110, the signal contacts 120 and the ground contacts 130. The holder 150 includes a plate-like portion 152 which extends forwards or towards the positive X-side in a plane defined by the mating direction and a pitch direction or Y-direction perpendicular to the mating direction, i.e. an XY-plane.

The shell 160 partially covers the holder 150. The shell 160 is formed with an opening 162, which is positioned backwards or towards the negative X-side on an upper surface or the positive Z-side surface of the shell 160. The inside of the shell 160 can be viewed through the opening 162 from the above of the shell 160.

Each of the signal contacts 110, the signal contacts 120 and the ground contacts 130 is made of a conductor. The signal contacts 110 are used for high-speed signal transmission while the signal contacts 120 are used for low-speed signal transmission.

As understood from FIGS. 2 to 4 and 6, each signal contact 110 includes a contact portion 112 to be connected to the mating connector (not shown) and a fixed portion 114 to be connected and fixed to the circuit board (not shown). Likewise, each signal contact 120 includes a contact portion 122 to be connected to the mating connector (not shown) and a fixed portion 124 to be connected and fixed to the circuit board (not shown), while each ground contact 130 includes a contact portion 132 to be connected to the mating connector (not shown) and a fixed portion 134 to be connected and fixed to the circuit board (not shown).

Figure 3:
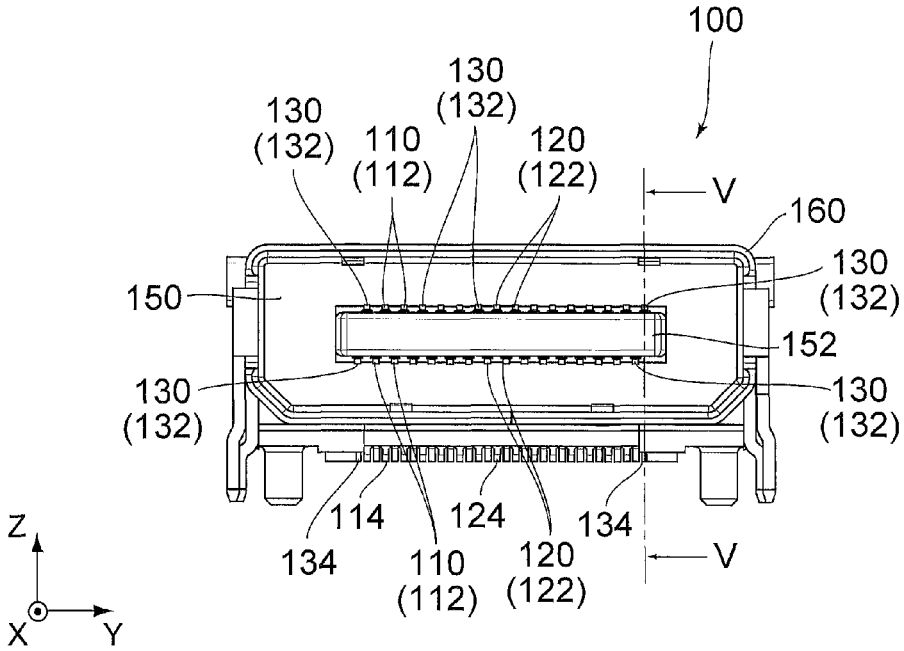
FIG. 3 is a front view showing the connector of FIG. 1.
Figure 6:
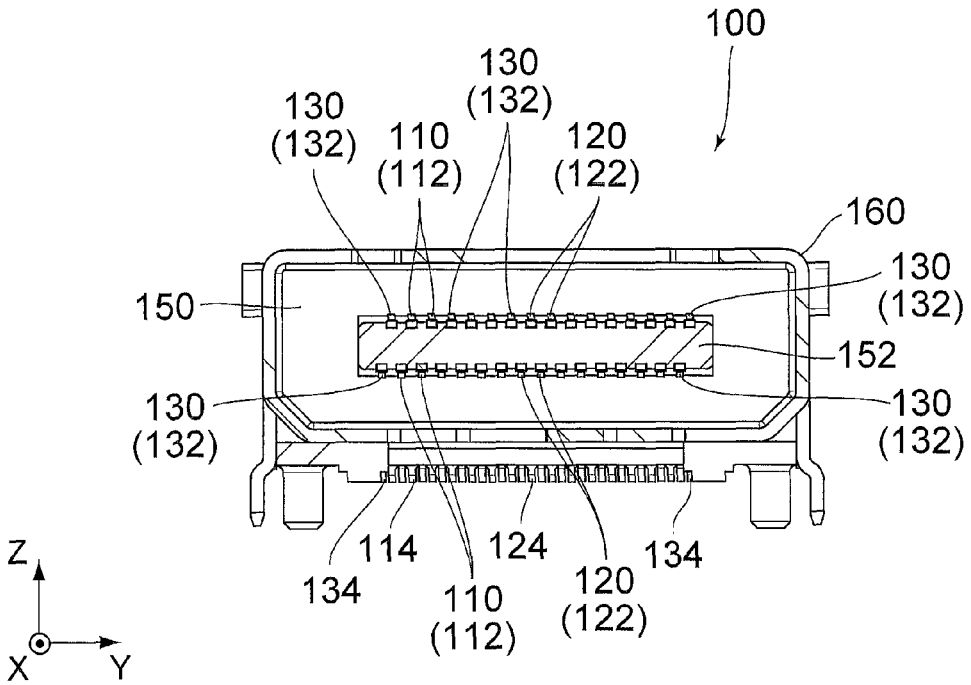
FIG. 6 is a cross-sectional view showing the connector of FIG. 4, taken along line VI--VI.
Figure 7:
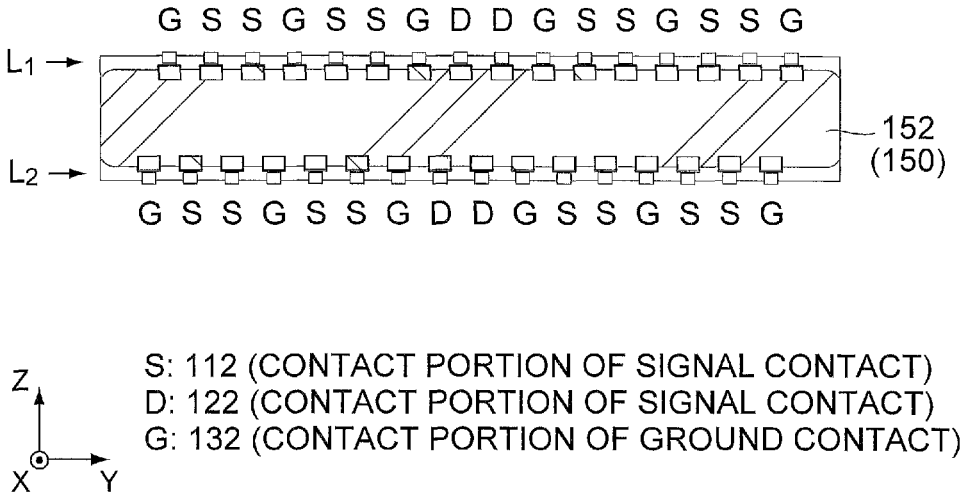

As shown in FIGS. 3 and 6, the contact portions 112, 122, 132 are grouped and arranged into two lines in a vertical plane perpendicular to the mating direction, i.e. a predetermined plane or a YZ plane. With further reference to FIG. 7, an upper line or the positive Z-side line of the two lines is referred to as a first line $L_1$ while a lower line or the negative Z-side line is referred to as a second line $L_2$, hereinafter.

As understood from FIGS. 3, 6 and 7, the contact portions 112, 122, 132 belonging to the first line $L_1$ are arranged to be exposed on an upper surface or the positive Z-side surface of the plate-like portion 152, while the contact portions 112, 122, 132 belonging to the second line $L_2$ are arranged to be exposed on a lower surface or the negative Z-side surface of the plate-like portion 152

In this embodiment, the contact portions 112, 122, 132 belonging to the first line $L_1$ are positioned at positions different in the pitch direction or the Y-direction from positions of the other contact portions 112, 122, 132 belonging to the second line $L_2$. In other words, the contact portions 112, 122, 132 are staggered. More specifically, the distance between the first line $L_1$ and the second line $L_2$ in an up-down direction or Z-direction is greater than the contact pitch in each of the first line $L_1$ and the second line $L_2$, i.e. the distance between the neighboring contact portions 112, 122, 132 in the pitch direction or the Y-direction.

As shown in FIG. 7, in each of the first line $L_1$ and the second line $L_2$, the contact portions 112 (S) of two signal contacts 110 constituting each pair are positioned between the contact portions 132 (G) of two ground contacts 130 in the pitch direction. Likewise, the contact portions 122 (D) of two signal contacts 120 constituting each pair are positioned between the contact portions 132 (G) of two ground contacts 130 in the pitch direction. In each of the first line $L_1$ and the second line $L_2$, two of the contact portions 132 (G) of the ground contacts 130 are positioned at opposite end positions in the pitch direction or the Y-direction.

Figure 8:
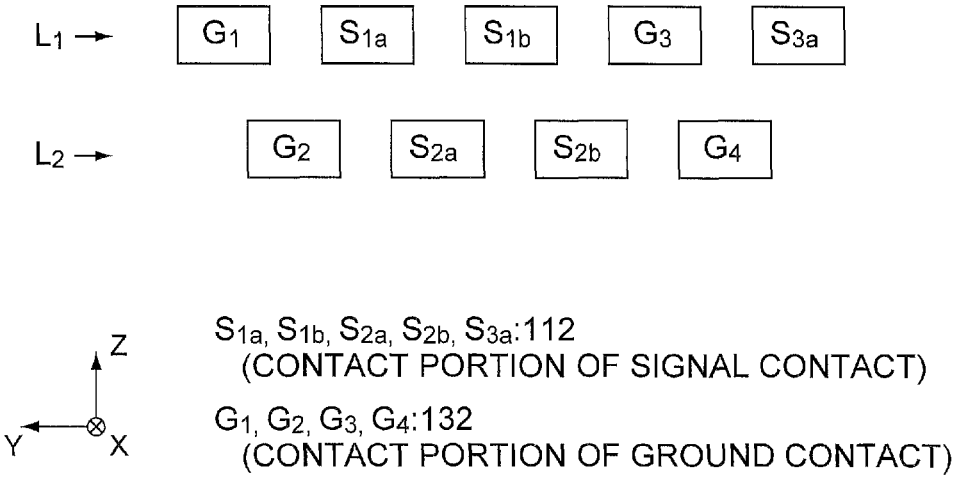
FIG. 8 is a diagram showing an arrangement of contact portions of contacts according to the preferred embodiment of the present invention.

Especially, as shown in FIG. 8, four "specific signal contact portions" ($S_{1a}$, $S_{1b}$, $S_{2a}$, $S_{2b}$) are surrounded by four "specific ground contact portions" ($G_1$, $G_2$, $G_3$, $G_4$) in the vertical plane or the YZ plane, wherein the four specific signal contact portions ($S_{1a}$, $S_{1b}$, $S_{2a}$, $S_{2b}$) are the contact portions 112 of the signal contacts 110 constituting two pairs, and the four specific ground contact portions ($G_1$, $G_2$, $G_3$, $G_4$) are two ($G_1$, $G_3$) of the contact portions 132 of the ground contacts 130 belonging to the first line $L_1$ and two ($G_2$, $G_4$) of the contact portions 132 of the ground contacts 130 belonging to the second line $L_2$.

In this connection, each contact portion 112 of the signal contact 110 other than the specific signal contact portions ($S_{1a}$, $S_{1b}$, $S_{2a}$, $S_{2b}$) is hereinafter referred to as "non-specific signal contact portion".

The wordings "specific signal contact portion", "specific ground contact portion" and "non-specific signal contact portion" are relative expressions. Namely, each contact portion 112 is sometimes assumed to be a "specific signal contact portion" and at other times is considered as a "non-specific signal contact portion". Even if one contact portion 112 is assumed to be a "specific signal contact portion" at one grouping, the contact portion 112 is not absolutely considered as the "specific signal contact portion" but is possibly considered as a "non-specific signal contact portion" at another grouping. Even if one contact portion 112 is assumed to be a "non-specific signal contact portion" at one grouping, the contact portion 112 is not absolutely considered as the "non-specific signal contact portion" but is possibly considered as a "specific signal contact portion" at another grouping.

A section between two specific ground contact portions closest to each other, e.g. a pair of specific ground contact portions ($G_1$ and $G_2$ or $G_3$ and $G_4$), functions as "grounding wall" which can prevent signals from affecting the other side of the grounding wall. For example, a distance between the specific ground contact portions ($G_3$ and $G_4$) constituting one grounding wall, or the minimum distance between two ($G_3$ and $G_4$) of the specific ground contact portions ($G_1$, $G_2$, $G_3$, $G_4$), is smaller than the minimum distance between one ($S_{2b}$) of the specific signal contact portions ($S_{1a}$, $S_{1b}$, $S_{2a}$, $S_{2b}$) and one ($S_{3a}$) of the non-specific signal contact portions. In other words, the distance between the specific ground contact portions ($G_3$ and $G_4$) constituting one grounding wall is smaller than a distance between the contact portions 112 ($S_{2b}$, $S_{3a}$) of two signal contacts 110 located on an imaginary line which intersects the grounding wall, or another imaginary line connecting between the specific ground contact portions ($G_3$ and $G_4$). Thus, the grounding wall can work properly so as to prevent one of the specific signal contact portions ($S_{1a}$, $S_{1b}$, $S_{2a}$, $S_{2b}$) and one of the non-specific signal contact portions ($S_{3a}$) from affecting each other. For example, the grounding wall formed by two specific ground contact portions ($G_3$ and $G_4$) can work properly so as to prevent the specific signal contact portion ($S_{2b}$) and the non-specific signal contact portion ($S_{3a}$) from affecting each other.

Figure 10:
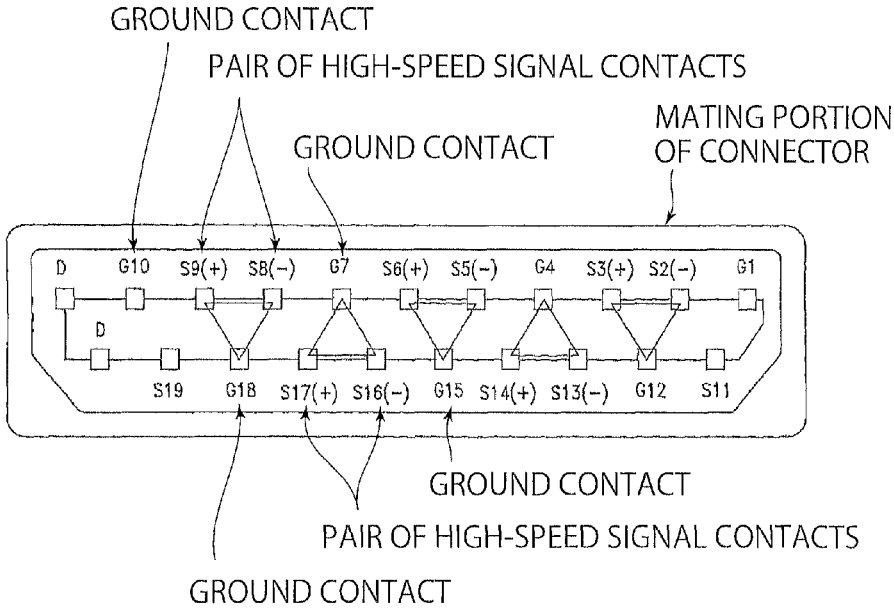
FIG. 10 PRIOR ART
FIG. 10 is a view showing a mating portion of the existing connector disclosed in JP 2011-519463 T.

On the contrary, with reference to FIG. 10, the existing connector of JP 2011-519463 T includes no pair of ground contacts which constitute a grounding wall as described above. For example, if attention is directed to two ground contacts ($G_7$, $G_{15}$) and two high-speed signal contacts ($S_6$, $S_{16}$), the ground contacts ($G_7$, $G_{15}$) are closest to each other among the ground contacts in the existing connector, and the high-speed signal contacts ($S_6$, $S_{16}$) are located on an imaginary line which intersects another imaginary line connecting between the ground contacts ($G_7$, $G_{15}$). However, a distance between the high-speed signal contacts ($S_6$, $S_{16}$) is smaller than another distance between the ground contacts ($G_7$, $G_{15}$). Therefore, the high-speed signal contacts ($S_6$, $S_{16}$) affect each other in the existing connector. Namely, cross-talk problems might occur in the existing connector.

Furthermore, the existing connector of JP 2011-519463 T has an arrangement where each pair of the high-speed signal contacts is located apart from other pairs of the high-speed signal contacts in its pitch direction. For example, a pair of the high-speed signal contacts ($S_8$, $S_9$) and another pair of the high-speed signal contacts ($S_{16}$, $S_{17}$) are arranged apart from each other in the pitch direction. Due to the arrangement, the effect of the high-speed signal contacts ($S_8$, $S_9$) on the high-speed signal contact ($S_{16}$) is very different from the effect of the high-speed signal contacts ($S_8$, $S_9$) on the high-speed signal contact ($S_{17}$). Depending upon use of the existing connector, independent controls of signals transmitted through the high-speed signal contacts are required to make small differences among the effects.

According to the present embodiment, a pair of the contact portions 112 ($S_{1a}$, $S_{1b}$) of the signal contacts 110 belonging to the first line $L_1$ is arranged to overlap with another pair of the contact portions 112 ($S_{2a}$, $S_{2b}$) of the signal contacts 110 belonging to the second line $L_2$ in the pitch direction, as shown in FIG. 8. In other words, the contact portions ($S_{1a}$, $S_{1b}$) for the first line $L_1$ and the contact portions ($S_{2a}$, $S_{2b}$) for the second line $L_2$ are alternately arranged in the pitch direction. Specifically, the contact portion ($S_{2a}$) for the second line $L_2$ is positioned between the contact portions ($S_{1a}$, $S_{1b}$) for the first line $L_1$ in the pitch direction, while the contact portion ($S_{1b}$) for the first line $L_1$ is positioned between the contact portions ($S_{2a}$, $S_{2b}$) for the second line $L_2$ in the pitch direction. Due to the arrangement, a difference between affection of the contact portions ($S_{1a}$, $S_{1b}$) on the contact portion ($S_{2a}$) and affection of the contact portions ($S_{1a}$, $S_{1b}$) on the contact portion ($S_{2b}$) is smaller than that of the existing connector. Therefore, the aforementioned independent controls are not required in the connector of the present embodiment.

Especially, in the present embodiment, the distance between the first line $L_1$ and the second line $L_2$ in the up-down direction or the Z-direction is greater than the contact pitch in each of the first line $L_1$ and the second line $L_2$, as described above. Therefore, the difference between affection of the contact portions ($S_{1a}$, $S_{1b}$) on the contact portion ($S_{2a}$) and affection of the contact portions ($S_{1a}$, $S_{1b}$) on the contact portion ($S_{2b}$) can be further reduced.

Figure 4:
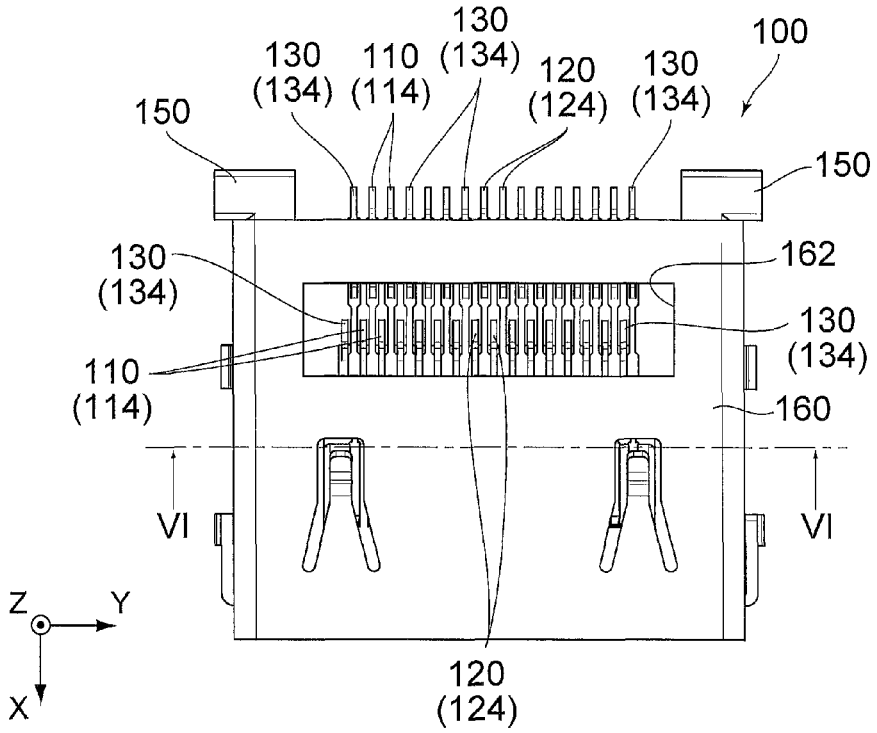
FIG. 4 is a top plan view showing the connector of FIG. 1.
Figure 5:
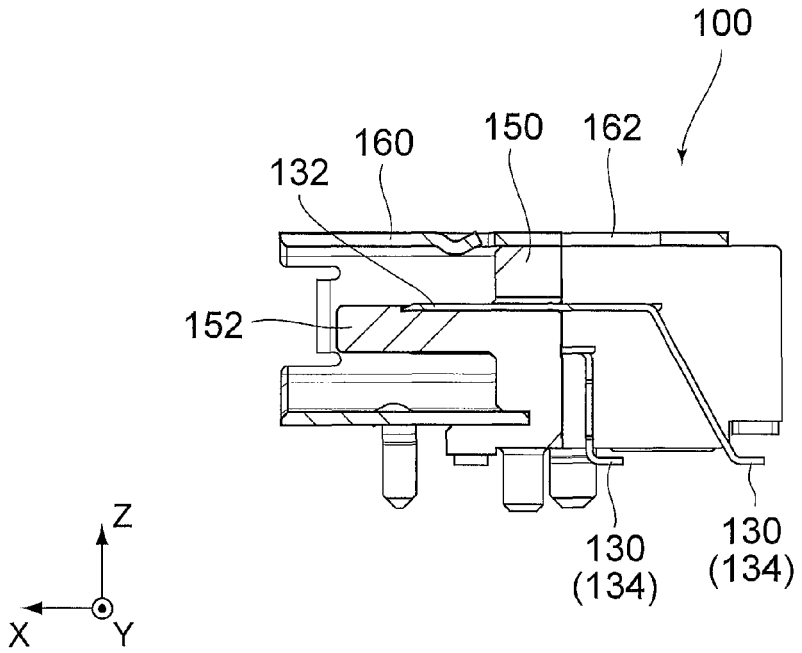
FIG. 5 is a cross-sectional view showing the connector of FIG. 3, taken along line V--V.
Figure 9:
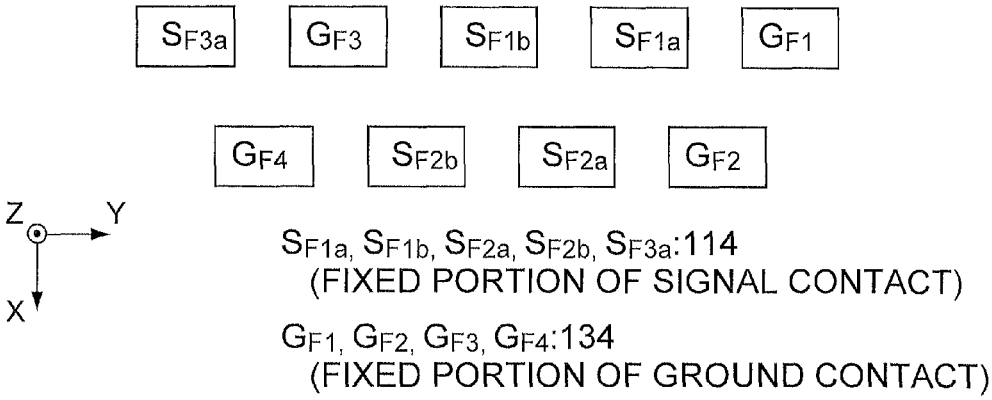
FIG. 9 is a diagram showing an arrangement of fixed portions of contacts according to the preferred embodiment of the present invention.

As understood from FIGS. 7 and 8 as well as FIGS. 4 and 9, the fixed portions 114, 124, 134 are staggered in correspondence with the staggered arrangement of the contact portions 112, 122, 132. Specifically, the fixed portions 114, 124, 134 are grouped and arranged in two lines in an XY plane or a plane perpendicular to the predetermined plane, i.e. a plane parallel with a circuit board (not shown) on which the connector 100 is mounted. With further reference to FIG. 5, the fixed portions 114, 124, 134 for the first line $L_1$ are positioned backwards or towards the negative X-side of the fixed portions 114, 124, 134 for the second line $L_2$. The fixed portions 114, 124, 134 for the first line $L_1$ are positioned at positions different in the pitch direction from the respective positions of the fixed portions 114, 124, 134 for the second line $L_2$.

Moreover, in each line, the fixed portions 114 of two signal contacts 110 constituting each pair are positioned between the fixed portions 134 of two ground contacts 130 in the pitch direction. Likewise, the fixed portions 124 of two signal contacts 120 constituting each pair are positioned between the fixed portions 134 of two ground contacts 130 in the pitch direction. In each line, two of the fixed portions 134 of the ground contacts 130 are positioned at opposite end positions in the pitch direction or the Y-direction.

With reference to FIG. 9, in the arrangement of the fixed portions 114, 124, 134, grounding walls work properly, and differences of affections among pairs of the fixed portions 114 of the signal contacts 110 are small. More in detail, the fixed portions 114 ($S_{F1a}$, $S_{F1b}$, $S_{F2a}$, $S_{F2b}$) of the signal contacts 110 are surrounded by the fixed portions 134 ($G_{F1}$, $G_{F2}$, $G_{F3}$, $G_{F4}$) of the ground contacts 130. In addition, between the fixed portions 114 ($S_{F1a}$, $S_{F1b}$, $S_{F2a}$, $S_{F2b}$) and the fixed portion 114 ($S_{F3a}$), a grounding wall is formed by the fixed portions 134 ($G_{F3}$, $G_{F4}$) of two ground contacts 130. The fixed portion 114 ($S_{F3a}$) is positioned outside of the grounding wall, while the fixed portions 114 ($S_{F1a}$, $S_{F1b}$, $S_{F2a}$, $S_{F2b}$) are positioned inside of the grounding wall. The grounding wall can prevent the fixed portion 114 ($S_{F3a}$) from affecting the fixed portions 114 ($S_{F1a}$, $S_{F1b}$, $S_{F2a}$, $S_{F2b}$). Furthermore, a pair of the fixed portions 114 ($S_{F1a}$, $S_{F1b}$) of the signal contacts 110 is arranged to overlap with another pair of the fixed portions 114 ($S_{F2a}$, $S_{F2b}$) of the signal contacts 110 in the pitch direction. Therefore, differences of affections among the fixed portions 114 ($S_{F1a}$, $S_{F1b}$, $S_{F2a}$, $S_{F2b}$) can be reduced.

Since the fixed portions 114, 124, 134 are staggered as shown in FIG. 4, they do not overlap with each other in the up-down direction. Therefore, when the connector 100 is mounted and connected on a circuit board (not shown), connection conditions of the fixed portions 114, 124, 134 to the circuit board can be viewed and confirmed through the opening 162 from the above or the positive Z-side of the connector 100.

Although the present invention is explained with the connector 100 of the preferred embodiment, the present invention is not limited thereto.

Although the connector 100 of the above-described embodiment is a receptacle connector, the present invention is not limited thereto. For example, the present invention is applicable to a plug connector.

Although the signal contacts 120 are used for low-speed signal transmission in the above-described embodiment, the signal contacts 120 may be used for high-speed signal transmission, similar to the signal contacts 110.

Although the contact portions 112, 122, 132 according to the above-described embodiment have no contact spring portions, the present invention is not limited thereto. The contact portions 112, 122, 132 may have contact spring portions, respectively.

Although the fixed portions 114, 124, 134 according to the above-described embodiment are for surface mount technology (SMT), the present invention is not limited thereto. For example, the fixed portions 114, 124, 134 may be for through-hole technology (THT) that inserts and fixes the fixed portions 114, 124, 134 into through-holes formed in a circuit board (not shown).

Although the plate-like portion 152 is simply made of insulator in the above-described embodiment, the present invention is not limited thereto. For example, a shield bar may be positioned between the first line $L_1$ and the second line $L_2$ to shield the first line $L_1$ and the second line $L_2$ electrically from each other.

The present application is based on a Japanese patent application of JP2013-031307 filed before the Japan Patent Office on Feb. 20, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector to be mated with a mating connector along a mating direction, wherein:

the connector comprises a plurality of pairs of signal contacts, a plurality of ground contacts and a holder which holds the pairs of the signal contacts and the ground contacts;

each of the signal contacts and the ground contacts includes a contact portion to be connected with the mating connector;

in a predetermined plane perpendicular to the mating direction, the contact portions of the signal contacts and the contact portions of the ground contacts are grouped and arranged into a first line and a second line;

the contact portions of the first line are equal in number to the contact portions of the second line;

in the predetermined plane, four specific signal contact portions are surrounded by four specific ground contact portions, the four specific signal contact portions being the contact portions of the signal contacts constituting two of the pairs, the four specific ground contact portions being two of the contact portions of the ground contacts belonging to the first line and two of the contact portions of the ground contacts belonging to the second line;

in the predetermined plane, a minimum distance between two of the specific ground contact portions is smaller than another minimum distance between one of the specific signal contact portions and one of the contact portions of the signal contacts other than the specific signal contact portions;

in each of the first line and the second line, the contact portions of the signal contacts and the ground contacts are arranged in a pitch direction perpendicular to the mating direction; and in each of the first line and the second line, two of the contact portions of the ground contacts are positioned at opposite end positions in the pitch direction.

2. The connector as recited in claim 1, wherein the contact portions are staggered.

3. The connector as recited in claim 2, wherein:

the connector is fixed to an object when used;

each of the signal contacts and the ground contacts has a fixed portion which is to be connected and fixed to the object;

and the fixed portions are staggered in correspondence with a staggered arrangement of the contact portions.

4. The connector as recited in claim 1, wherein:

in a pitch direction perpendicular to the mating direction, one of the contact portions of two of the signal contacts constituting one of the pairs belonging to the second line is positioned between the contact portions of two of the signal contacts constituting one of the pairs belonging to the first line; and in the pitch direction, one of the contact portions of two of the signal contacts constituting one of the pairs belonging to the first line is positioned between the contact portions of two of the signal contacts constituting one of the pairs belonging to the second line.

* * * * *